US008353710B2

(12) United States Patent
Johansson

(10) Patent No.: US 8,353,710 B2
(45) Date of Patent: Jan. 15, 2013

(54) LOW-VOLTAGE CONTACTOR

(75) Inventor: Mats Johansson, Vasteras (SE)

(73) Assignee: ABB AB (SE)

( * ) Notice: Subject to any disclaimer, the term of this patent is extended or adjusted under 35 U.S.C. 154(b) by 0 days.

(21) Appl. No.: 13/365,995

(22) Filed: Feb. 3, 2012

(65) Prior Publication Data

US 2012/0135646 A1 May 31, 2012

Related U.S. Application Data

(63) Continuation of application No. PCT/EP2009/060076, filed on Aug. 4, 2009.

(51) Int. Cl.
*H01R 13/44* (2006.01)

(52) U.S. Cl. ..... 439/132; 439/192

(58) Field of Classification Search ..... 335/132, 335/192

See application file for complete search history.

(56) References Cited

U.S. PATENT DOCUMENTS

| | | | | |
|---|---|---|---|---|
| 3,873,952 | A * | 3/1975 | Kondo et al. | 335/192 |
| 4,409,574 | A * | 10/1983 | Misencik et al. | 335/18 |
| 5,635,886 | A * | 6/1997 | Pichard | 335/132 |
| 5,834,996 | A * | 11/1998 | Ullermann | 335/6 |
| 5,844,457 | A * | 12/1998 | Eckroth et al. | 335/132 |
| 6,204,740 | B1 * | 3/2001 | Nakahata | 335/4 |
| 6,233,131 | B1 * | 5/2001 | Kappel et al. | 361/160 |
| 2002/0149452 | A1 * | 10/2002 | Baujan et al. | 335/132 |

FOREIGN PATENT DOCUMENTS

| | | | |
|---|---|---|---|
| DE | 2027136 | A1 | 4/1972 |
| EP | 0645792 | A1 | 3/1995 |
| FR | 2612686 | A3 | 9/1988 |
| JP | 10233150 | A | 9/1998 |

OTHER PUBLICATIONS

International Preliminary Report on Patentability; Application No. PCT/EP2009/060076; Issued: Sep. 5, 2011; 17 pages.

International Search Report and Written Opinion of the International Searching Authority; Application No. PCT/EP2009/060076 ; Issued: Mar. 23, 2010; Mailing Date: Mar. 30, 2010; 10 pages.

* cited by examiner

*Primary Examiner* — Truc Nguyen

(74) *Attorney, Agent, or Firm* — St. Onge Steward Johnston & Reens LLC

(57) ABSTRACT

A low-voltage contactor with an actuating unit, a stationary contact, and a contact carrier operated by the actuating unit and including a movable contact, a spring with a first end and a second end acting on the movable contact to produce a force that reduces the electrical resistance between the contacts, and a connecting means for connecting the contact carrier to the actuating unit. The contact carrier includes a framework part including the connecting means, a holder part including a holding member adapted to receive and hold the movable contact and the spring. The holder part and the framework part are detachably connected to each other and designed so that the first end of the spring is acting on the movable contact held by the holder part and the second end is acting on the framework part when the framework part and the holder part are connected to each other.

11 Claims, 2 Drawing Sheets

LOW-VOLTAGE CONTACTOR

CROSS-REFERENCE TO RELATED APPLICATIONS

The present application is a continuation of pending International patent application PCT/EP2009/060076 filed on Aug. 4, 2009 which designates the United States, the content of which is incorporated herein by reference.

FIELD OF THE INVENTION

The present invention relates to a low-voltage contactor for controlling an electric power or control circuit of an electrical device such as a motor, a lighting unit, a heating apparatus or a capacitor bank. The range of the low-voltage is up to 1000 V AC or 1500 V DC.

BACKGROUND OF THE INVENTION

A low-voltage contactor comprises an actuating unit, a stationary contact, and a contact carrier including a movable contact that is operated by the actuating unit, a spring acting on the movable contact to produce a force that reduces the resistance between the contacts and a connecting member for connecting to the contact carrier to the actuating unit. However, to assemble the movable contact and the spring together with the contact carrier so that the spring acting on the movable contact to produce the force to reduce the resistance between the contacts, a relatively complicated mounting process is used, namely, the movable contact is first placed on the contact carrier from the one side of the contact carrier, then the spring is place, top-down, on the movable contact that is sitting on the contact carrier, the spring has then to be pressed so as, when it is released, to act on both the movable contact and the contact carrier. Such a manufacturing process is difficult to be automated since the assembly includes steps to be performed from different directions. Therefore, an alternative solution is highly desired so that the assembling process of a contact carrier is easily automated.

DE 2027136A1 discloses an electromagnetic switching device including a contact bridge carrier holding a movable contact and being connected to an armature of the actuating unit. The switching device is designed in the form of a comb and having a cover that closes off the openings delimited by the comb teeth.

SUMMARY OF THE INVENTION

The object of the present invention is to provide a stable contact carrier which is easy to be automatically assembled.

This object is achieved by a low-voltage contactor for controlling an electric power or control circuit of an electrical device.

Such a contactor comprises an actuating unit, a stationary contact, and a contact carrier which further comprises a framework part including the connecting means and a holder part including a holding member adapted to receive and hold the movable contact and the spring, the holder part and the framework part are arranged to be detachably connected to each other, and the holder part and the framework part are designed so that the first end of the spring is acting on the movable contact held by the holder part and the second end is acting on the framework part when the framework part and the holder part are connected to each other, characterized in that the framework part further comprises a spring positioner (22, 22', 22") adapted to retain the second end of the spring so that the spring is in a stable position with respect to the framework part and the movable contact (30, 30', 30") is designed to be received by the holding member (15, 15', 15") and further comprises a spring positioner (32, 32', 32") to retain the first end of the spring so that the spring is in a stable position with respect to the movable contact so as to prevent the holder part gliding from the framework part.

By providing a spring positioner on the framework part and the holder part respectively, the spring is retained in a stable position with respect to the framework part and the movable contact. Meanwhile, the pressed spring between the framework part and the holder part prevents the holder part sliding off from the framework part. Therefore, a stable contact carrier is enabled. In this way the spring is able to produce a desired force on the movable contact so that the contact area is maximized. Therefore, the electrical resistance between the movable and stationary contacts is reduced when they are in contact with each other.

Due to the fact that the assembling/mounting steps can be performed sequentially in one direction, it is easier to automate assembling process of the contact carrier. An automated assembling may comprise the following steps: placing the movable contact on the holding member of the holder part, placing the spring to the spring positioner of the movable contact so that the first end of the spring is positioned by the spring positioner, pressing the spring down against the movable contact and, as a last step, connecting the framework part and the holder part by the connectors so that the second end of the spring is positioned by the positioner of the framework part, which results in the first end of the spring acting on the movable contact held by the holder part and the second end of the spring acting on the framework part so that the spring is able to produce a force that reduces the electrical resistance between the contacts when they are in contact with each other. All the above steps except the last one may be carried out sequentially in a top-down direction. Therefore, the object of providing a stable contact carrier which can be also automating assembled is achieved.

The framework part and the holder part further respectively comprise a linking means, which are designed to be connected to each other.

Due to the fact that the contact carrier is composed of two separate physical parts, the framework part and the holder part, it is possible to use different thermal and electrical insulation materials with different thermal, mechanical and molding properties to make the framework part and the holder part, respectively. It is advantageous to manufacture the framework part and the holder part using different thermal and electrical materials, since it is then possible to make the framework part of a thermal and electrical material that is easily molded during the manufacturing so the machine processing time of contact carriers is shortened.

According to an embodiment of the invention, the second thermal and electrical insulation material is thermosetting plastic material. It is advantageous to make the holder part of thermosetting plastics since they possess properties of strong resistance to heat and good electrical insulation. Therefore, the holder part is able to withstand to thermal stresses constantly loaded on the holder part. Thermosetting plastics or thermosets are polymer materials that irreversibly cure.

According to an embodiment of the invention, the first thermal and electrical insulation material is thermoplastic material. A thermoplastic is a polymer that turns to a liquid when heated and freezes to a very glassy state when cooled sufficiently. It is advantageous to make the framework part of a thermoplastic material, because such a thermoplastic can go through melting/freezing cycles repeatedly, which makes it more easily handled during the manufacturing compared to thermosetting plastic materials. Therefore, the manufacturing time of contactors is can be shortened considerably and the cost for producing the contactors is therefore reduced. Furthermore, a contactor is often used to control an electric power to another electrical device, for example, a motor. The motor, during its lifetime, will be connected and disconnected to the electric power up to 10 million times. In each such connecting and disconnecting operation, the contact carrier carries the movable contact moving forwards or backwards between an initial position and a final working position to enable a contact or disable a contact with a stationary contact, which means that the contact carrier is constantly exposed to a mechanical deterioration during each connection and disconnection of contacts. By making the framework part using thermoplastic materials which possess the properties of durability and mechanical stiffness, the contact carrier is able to withstand mechanical deterioration. Yet another advantage is that thermoplastic material is re-moldable and recyclable, which therefore is beneficial for the sustainability of contactors.

BRIEF DESCRIPTION OF THE DRAWINGS

The invention will now be explained more closely by the description of different embodiments of the invention and with reference to the appended figures.

DETAILED DESCRIPTION OF THE INVENTION

Figure 1:
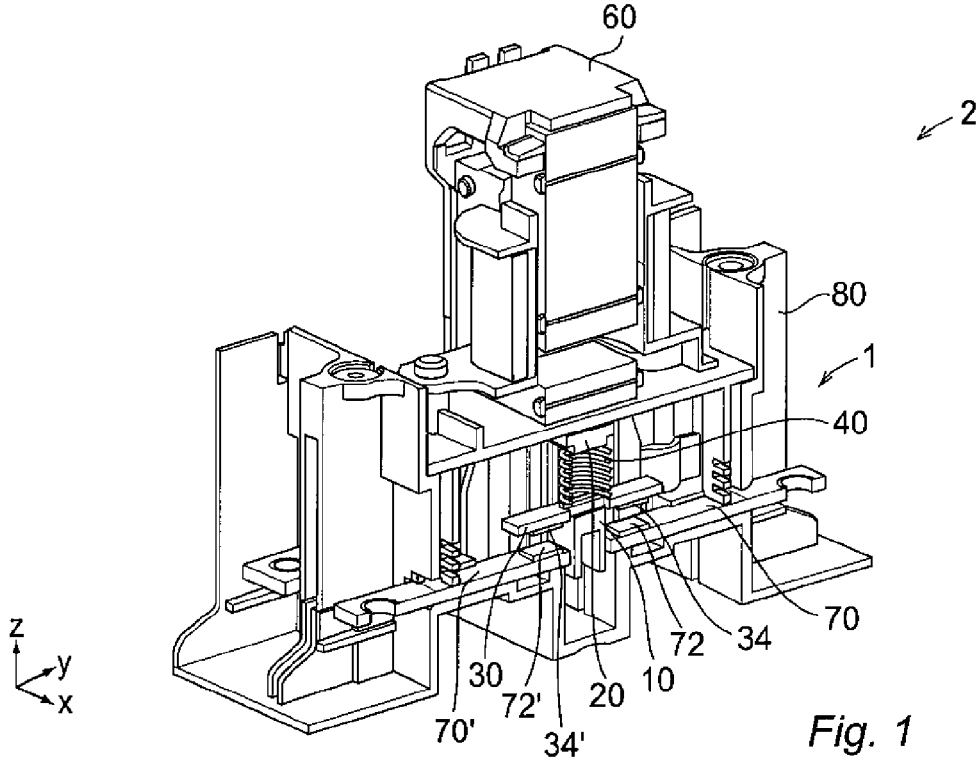
FIG. 1 illustrates a partial cross-sectional view of an uncovered contactor having a contact carrier, according to a first embodiment of the invention.

FIG. 1 shows a partial cross-sectional view of a contactor having a contact carrier, according to a first embodiment of the invention. The contactor 2 includes an actuating unit 60, a stationary contact 70, and a contact carrier 1 having a framework part 20 and a holder part 10 including a movable contact 30 and a spring 40. In this embodiment, the contactor is a three-pole low-voltage contactor. It is understood that the view is a portion of the contactor, and therefore not all the elements of the contactor are illustrated in the figure. The number of the movable contacts depends on the number of the poles. In this embodiment, three movable contacts have been provided.

The stationary contact 70 is sited on a housing 80 of the contactor 2. In this embodiment, two stationary contacts 70, 70' are arranged aligned with for each movable contact 30. Each stationary contact 70, 70' includes a contact surface 72, 72'.

The movable contact 30 includes two movable contact surfaces 34, 34' sited respectively on each end of the movable contact on the same side of the movable contact.

The function of the actuating unit 60 is to drive the contact carrier 1 moving towards the stationary contact 70, 70' so that contacts are made between surfaces 72, 72' and 34, 34' of the stationary contacts 70, 70' and the movable contact 30. Such an actuating unit may be an electromagnet apparatus electrically connected to an electrical circuit arranged for supplying electric power to energize the electromagnet. An electromagnetic force is then produced for driving the contact carrier 1 moving, from a rest position, downwards to the stationary contact and eventually an electrical contact is made between the contact surfaces 72, 72', 34, 34' of the stationary and movable contacts 70, 70', 30 at a working position.

The contact carrier 1 includes the framework part 20 and the holder part 10 positioned so that the stationary contacts 70, 70' are aligned with the movable contact 30 in an opening position.

Figure 2:
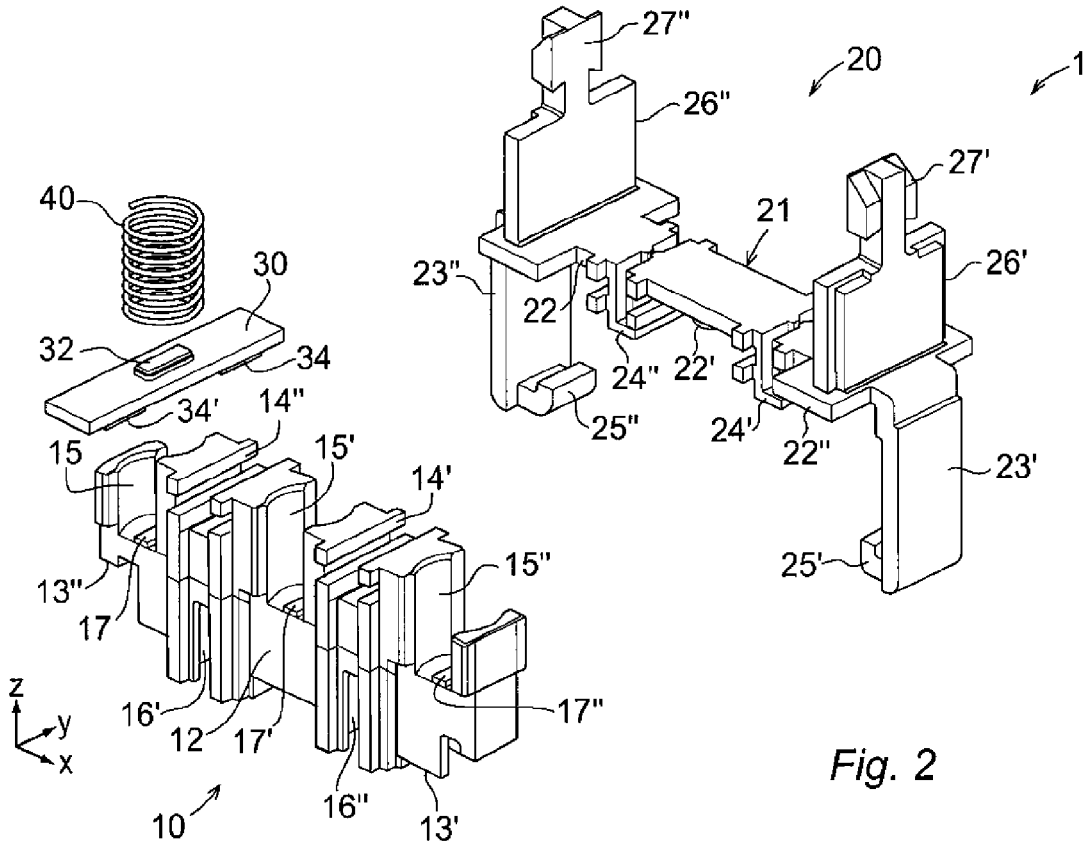
FIG. 2 shows a detailed isometric view of the contact carrier illustrated in FIG. 1.

A detailed isometric view of the contact carrier is further illustrated in FIG. 2, according to the first embodiment of the invention. In this figure, the other two movable contacts and springs have been removed for a better illustration.

The framework part 20 includes an elongated body 21, a connecting means for mechanically connecting the contact carrier 1 to the actuating unit 60 and a linking means for coupling the framework part 20 to the holder part 10.

In this embodiment, the connecting means includes two connectors 26', 26" protruding from the ends of the body 21. Each of the connectors 26', 26" is provided with a connection mechanism 27', 27", for example a snap hooking mechanism. The linking means includes four coupling elements 23', 23", 24', 24" for coupling the framework part and the holder part in a stable position with respect to the Z- and X-axes. The first and second coupling elements 23', 23", protruding from the ends of the body in a direction opposite the two connectors, include respectively hooking elements 25', 25" arranged at the free end of the coupling elements 23', 23" and protruding inwardly to cooperate with corresponding hooking means of the holder part. The third and fourth coupling elements 24', 24", protruding in the same direction as the first and second coupling elements, are arranged between the first and second coupling elements 23', 23". Each of the third and fourth coupling elements 24', 24" including two protruding bars arranged on each side is therefore in the form of a criss-cross for cooperating with corresponding coupling elements of the holder part. Preferably, the framework part 20 is made in one piece and of an electrical insulation material having such stiff and strong mechanical properties so as to withstand mechanical wear caused by movements of the contact carrier, for example, a thermoplastic material. A suitable thermoplastic may be any type of polyamide, polyethylene, polybutylene terephthalate, polycarbonate or polypropylene. They may be either fiberglass-filled or without filled fiberglass.

The holder part 10 includes a frame 12 provided with holding members 15, 15', 15" in the form of recesses for receiving the movable contacts and the springs. The number of the recesses depends on the number of the movable contacts.

In this embodiment, three recesses are provided on the frame 12. Each recess has a ring-shaped wall provided with an inlet opening in the direction of the Z-axis for receiving a movable contact and thereon a spring, and two opposite openings in the direction of the Y-axis for allowing the movable contact surfaces extending beyond the recess. A movable contact retainer 17, 17', 17" is provided by each recess for receiving and retaining a movable contact. In this embodiment, on the opposite side of the recesses, two other spring holding elements 16', 16" are provided in the form of recesses for holding restoring springs to enable the contact carrier to move back to the rest position from the working position when a disconnecting operation is conducted. The frame is provided with four coupling elements 13', 13", 14', 14" to cooperate correspondingly with the coupling elements 23', 23", 24', 24". The first and second coupling elements 13', 13" are formed to be hooked with the hooking elements 25', 25" of the first and second coupling elements 23', 23" of the framework part. The third and fourth coupling elements 14', 14"

have grooves in the form of a criss-cross for matching the criss-cross-shaped third and fourth coupling elements 24', 24" provided on the framework part. Preferably, the holder part 10 is made in one piece and of an electrical insulation material having such thermal properties so as to withstand thermal stresses, for example thermosetting plastic material. A suitable thermosetting plastic may be any type of melamine formaldehyde, epoxy or phenol formaldehyde and is normally used together with a type of fiber such as fiberglass, carbon fiber, cotton fiber or Kevlar.

In this embodiment, the movable contact 30 further includes a spring positioner 32 for retaining the first end of the spring. The spring positioner is arranged on one side of the movable contact in the middle of the movable contact. The spring positioner 32 is formed in the same shape as the movable contact retainer 17, so a groove formed on the other side matches the shape of the movable contact retainer.

In this embodiment, The framework part further includes three spring positioners 22, 22', 22" arranged between the coupling elements 23' and 24', 24' and 24" and, 24" and 23", respectively. Each spring positioner 22, 22', 22" is formed to retain the second end of the spring.

Figure 3A:
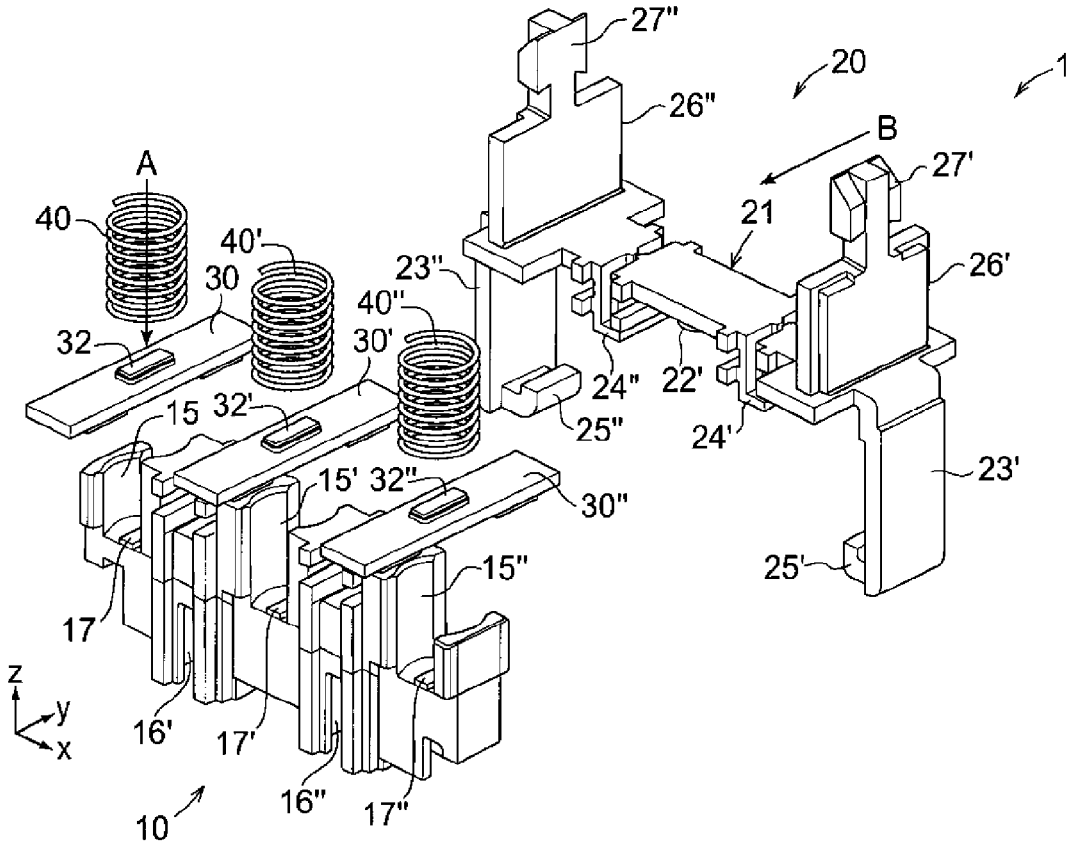
FIG. 3*a* illustrates an assembling procedure of the contactor carrier shown in FIG. 2.

FIG. 3*a* illustrates an assembling procedure of the contactor carrier shown in FIG. 2.

The arrow A represents an assembling direction for the first three steps as the following: 1) mounting the movable contact 30 on the holding member 15 of the holder part 10, 2) mounting the spring 40 on the spring positioner 32 of the movable contact 30 and 3) pressing the spring down. The last step is mechanically connecting the framework part 20 with the holder part 10 in an either left to right or right to left direction shown as the arrow B. This means that the assembling directions are simplified along firstly a longitudinal Z-axis, followed by a latitudinal Y-axis; it is therefore easier to automate the assembling steps.

Figure 3B:
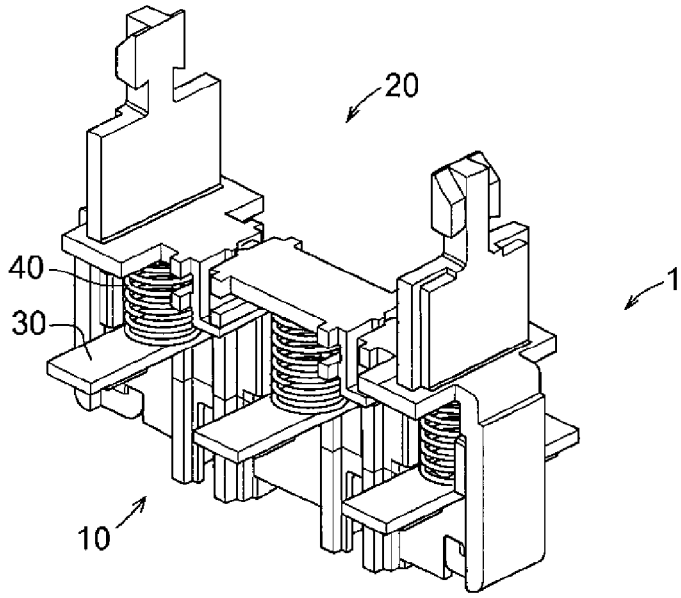
FIG. 3*b* illustrates the assembled contact carrier shown in FIG. 2.

When the contact carrier 1 is assembled as shown in FIG. 3*b*, the movable contacts 30, 30', 30" are placed on the movable contact retainer 17, 17', 17" provided by the corresponding holding member 15, 15', 15", then the spring 40, 40', 40" are placed on the movable contact 30 with the first end positioned by the spring positioner 32, 32', 32". The spring 40, 40', 40" are pressed downwards to the movable contact 30, 30', 30" and the holder part 10 is coupled with the framework part 20 by the coupling elements provided by the framework part and holder part, respectively. The coupled framework part 20 and holder part 10 is in a stable position with respect to the Z- and X-axes, while the pressed spring 40, 40' 40" retained by the spring positioners 22, 22', 22', 32, 32', 32" on each end results in the contact carrier 1 now also being in a stable position with respect to the Y-axis. Therefore, all parts in the assembled contact carrier are stable with respect to the X-, Y- and Z-axes as the framework part and holder part were built in one piece. A pressed spring generates a force on the movable contact to enable a maximum contact area between the movable and stationary contacts to reduce the electrical resistance.

What is claimed is:

1. A low-voltage contactor comprising:

an actuating unit, a stationary contact, and a contact carrier operated by the actuating unit and including a movable contact, a spring having a first end and a second end and acting on the movable contact to produce a force that reduces the resistance between the stationary and movable contacts and a connecting means for connecting to the contact carrier to the actuating unit, wherein the contact carrier comprises, a framework part including the connecting means, a holder part including a holding member adapted to receive and hold the movable contact and the spring, the holder part and the framework part are arranged to be detachably connected to each other such that said holder part is slid into said framework part in a direction perpendicular to the force of the spring acting between said framework part and said holder part and, the holder part and the framework part are designed so that the first end of the spring is acting on the movable contact held by the holder part and the second end is acting on the framework part when the framework part and the holder part are connected to each other, wherein the framework part includes a framework spring positioner retaining the second end of the spring so that the spring is in a stable position with respect to the framework part and the movable contact is received by the holding member, and wherein the contact carrier includes a carrier spring positioner retaining the first end of the spring so that the spring is in a stable position with respect to the movable contact so as to prevent the holder part gliding from the framework part.

2. The low-voltage contactor according to claim 1, wherein the framework part and the holder part further respectively comprise a linking means, the linking means are designed to be connected to each other.

3. The low-voltage contactor according to claim 1, wherein the framework part is made of a first thermal and electrical insulation material.

4. The low-voltage contactor according to claim 1, wherein the holder part is made of a second thermal and electrical insulation material different from the first thermal and electrical insulation material.

5. The low-voltage contactor according to claim 4, wherein the second thermal and electrical insulation material is a thermosetting plastic material.

6. The low-voltage contactor according to claim 4, wherein the first thermal and electrical insulation material is a thermoplastic material.

7. The low-voltage contactor according to claim 5, wherein the first thermal and electrical insulation material is a thermoplastic material.

8. The low-voltage contactor according to claim 1, wherein the framework spring positioner comprises a raised portion on the framework part that interacts with the spring such that the second end of the spring is prevented from displacing laterally with respect to a longitudinal axis of the spring.

9. The low-voltage contactor according to claim 8, wherein the carrier spring positioner comprises a raised portion that interacts with the spring such that the first end of the spring is prevented from displacing laterally with respect to a longitudinal axis of the spring.

10. The low-voltage contactor according to claim 9, wherein the carrier spring positioner is positioned on the movable contact.

11. The low-voltage contactor according to claim 10, wherein the holder part includes a contact retainer that comprises a raised portion that interacts with a cavity located in the movable contact such that the movable contact is prevented from sliding out of the holder part.

* * * * *